US009103538B2

(12) United States Patent
Flores et al.

(10) Patent No.: US 9,103,538 B2
(45) Date of Patent: Aug. 11, 2015

(54) PORTABLE ELECTRIC LAMP WITH A COMPACT CASING HOUSING A LIGHTING MODULE CONTROLLED BY A ROTARY ACTUATOR

(71) Applicant: ZEDEL, Crolles (FR)

(72) Inventors: Nicolas Flores, Gieres (FR); Raphael Bortolotti, Annecy-le-Vieux (FR)

(73) Assignee: ZEDEL, Crolles (FR)

( * ) Notice: Subject to any disclaimer, the term of this patent is extended or adjusted under 35 U.S.C. 154(b) by 138 days.

(21) Appl. No.: 13/789,070

(22) Filed: Mar. 7, 2013

(65) Prior Publication Data

US 2013/0242545 A1 Sep. 19, 2013

(30) Foreign Application Priority Data

Mar. 14, 2012 (FR) ..... 12 00769

(51) Int. Cl.

| | |
|---|---|
| ***F21V 23/04*** | (2006.01) |
| ***F21L 4/00*** | (2006.01) |
| ***F21L 14/00*** | (2006.01) |
| *F21L 4/02* | (2006.01) |
| *F21Y 101/02* | (2006.01) |

(52) U.S. Cl.

CPC ..... *F21V 23/0414* (2013.01); *F21L 4/00* (2013.01); *F21L 14/00* (2013.01); *F21L 4/027* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 5,410,461 | A | 4/1995 | Petzl | |
| 6,024,471 | A | 2/2000 | McDermott | |
| 2006/0266634 | A1 * | 11/2006 | Shahmuradyan | 200/564 |
| 2012/0042745 | A1 * | 2/2012 | Hamm et al. | 74/553 |

FOREIGN PATENT DOCUMENTS

| | | |
|---|---|---|
| CA | 1071602 | 2/1980 |
| FR | 2 336 629 A1 | 7/1977 |
| FR | 2 708 714 A1 | 2/1995 |

* cited by examiner

*Primary Examiner* — Britt D Hanley
(74) *Attorney, Agent, or Firm* — Oliff PLC

(57) ABSTRACT

A portable electric lamp with a compact casing housing a lighting module and an electric circuit coupled to the lighting module and provided with a controlled switch, comprising an actuator rotating around an axis of rotation and mounted fixed in translation in the direction of said axis of rotation to control the switch, and a control knob rotating around the axis of rotation of the actuator, the control knob further being mounted movable in translation along the axis of rotation of the actuator between a driving position in which the control knob drives the actuator in rotation and at least one blocking position in which the control knob prevents rotation of the actuator in at least one direction of rotation.

10 Claims, 4 Drawing Sheets

PORTABLE ELECTRIC LAMP WITH A COMPACT CASING HOUSING A LIGHTING MODULE CONTROLLED BY A ROTARY ACTUATOR

BACKGROUND OF THE INVENTION

The invention relates to a portable electric lamp with a compact casing housing a lighting module controlled by a rotary actuator, and in particular a portable electric headlamp used in mountaineering.

STATE OF THE ART

At present, portable electric lamps of small dimensions are used comprising a lighting module housed in a casing having a compact body. The lamp generally comprises a support provided with a strap enabling the lamp to be worn on the head. The lamp further comprises an electric circuit coupled to the lighting module and provided with at least one controlled switch in order to control lighting of the lamp. The lighting module can comprise one or more light-emitting diodes (LED) or different bulbs, to provide various lighting modes, for example lighting of coloured type, white lighting, more or less intense lighting, etc. The switches can be commanded by means of a rotary actuator which moves in translation inside the casing to take a locked position in which it does not rotate. But the tightness of such a lamp is not guaranteed due to the movement of the actuator in translation. Furthermore, a special space for movement of the actuator has to be provided in the casing, which increases the volume of the casing and makes the lamp less compact.

French Patent application FR 2,708,714 can be cited which discloses an electric lighting lamp comprising an actuator mounted rotating to control total extinguishing or illumination of the lamp. The lamp further comprises a locking latch situated in a central position of the actuator. The latch enables the actuator to be locked in a rest position in which the switches are open and the lamp is extinguished. The latch is lowered to a depressed position so as to prevent any rotation of the actuator. But such a latch blocks the actuator completely and does not enable rotation in a single direction of rotation to enable for example emergency lighting or extinguishing of the lamp. The latch being housed in the control system further means that the user has to unlock the actuator by placing his/her fingers on the latch and then selecting a lighting mode by moving the actuator in rotation. This use is rendered difficult when the user has a limited visibility.

OBJECT OF THE INVENTION

The object of the invention consists in remedying these drawbacks and in providing a portable electric lamp equipped with means for preventing rotation of a lighting control actuator, in at least one direction of rotation, that is efficient and simple to use.

According to one feature of the invention, a portable electric lamp is proposed with a compact casing housing a lighting module and an electric circuit coupled to the lighting module and provided with a controlled switch, the portable electric lamp comprising:

- an actuator rotating around an axis of rotation to control the switch, the actuator being mounted fixed in translation in the direction of said axis of rotation, and
- a control knob rotating around the axis of rotation of the actuator, the control knob further being mounted movable in translation along the axis of rotation of the actuator between a driving position in which the control knob drives the actuator in rotation and at least one blocking position in which the control knob prevents rotation of the actuator in at least one direction of rotation.

Simple means of use are thus provided to block the actuator controlling lighting of the lamp in at least one direction of rotation. It is then possible for example to disable an increase of the lighting power while at the same time enabling reduction or extinction of the lighting, or vice-versa. A lamp is also provided having a lighting control actuator which is both driven and blocked by a single control knob, thereby facilitating use of the latter, in particular for emergency situations or when the lamp is used in poor visibility conditions. The actuator is further mounted fixed in translation, in particular to improve the tightness of the casing and to reduce the internal volume of the casing so as to make the lamp even more compact. Transmission of control between the actuator and the switch is also improved.

The control knob can comprise a pin, and the casing comprises at least one stop to block the pin in at least one direction of rotation of the actuator when the control knob is in said blocking position.

The casing can comprise at least two stops arranged around an insert shaped to receive the pin, when the control knob is in said blocking position, so as to prevent rotation of the actuator in both directions of rotation.

Any involuntary lighting of the lamp is thus prevented.

The portable electric lamp can comprise means for indexing in translation to keep the control knob in a determined translation position.

According to an embodiment, the actuator comprises a drive bar fitted through the casing and provided with a cam designed to control the switch.

According to another embodiment, the switch comprises an inductive or capacitive sensor and the actuator comprises a magnet designed to control the switch.

Switches called contact-free switches can thus be used, which enables the size of the casing to be reduced.

According to another embodiment, the lamp comprises at least one spring fitted between the casing and the actuator to enable rotation of the actuator and to return the latter to a rest position.

The portable electric lamp can also comprise at least one spring fitted between the control knob and the casing to enable translation and rotation of the control knob and to return the latter from the driving position to said blocking position.

According to yet another embodiment, the portable electric lamp comprises means for indexing in rotation to keep the actuator in a determined angular position.

The casing can further comprise several stops and several inserts, each insert being located between two stops and being shaped such as to receive the pin, when the control knob is in said blocking position, so as to prevent rotation of the actuator in both directions of rotation.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
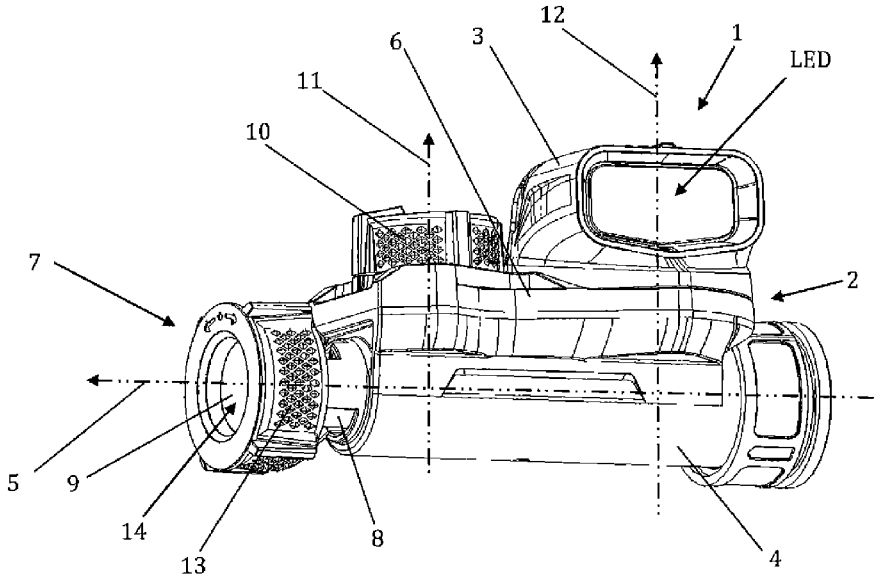
FIG. 1 schematically illustrates a perspective view of an embodiment of a portable electric lamp according to the invention.

A portable electric lamp 1 comprising a compact casing 2 housing a lighting module 3 preferably provided with a light-emitting diode (LED) has been represented in schematic manner in FIG. 1. Lighting module 3 can also comprise several LEDs, which can be power or standard LEDs. Portable electric lamp 1 can be a headlamp or a torch lamp, and casing 2 can be made from insulating or metallic material.

Casing 2 comprises a substantially cylindrical bottom part 4 extending along a longitudinal axis 5, and a substantially rectangular top part 6. Bottom part 4 comprises a main actuator 7 which rotates around longitudinal axis 5, also noted axis of rotation 5 of main actuator 7. Main actuator 7 enables lighting of the LED to be controlled, and is situated at a first end of bottom part 4. Main actuator 7 comprises a drive bar 8 extended at a first end by a substantially cylindrical head 9. Drive bar 8 is mounted rotating around longitudinal axis 5, and is blocked in translation with respect to longitudinal axis 5. In other words, drive bar 8 is mounted fixed in translation with respect to bottom part 4 of casing 2, and moves only in rotation around longitudinal axis 5. Lamp 1 can also comprise an additional actuator 10 rotating around a second axis of rotation 11 substantially perpendicular to axis of rotation 5 of main actuator 7. Main actuator 10 can also control lighting of other LEDs, for example an infrared LED, or it can control lighting intensity levels or different lighting modes. Advantageously, lighting module 3 can be mounted movable in rotation around a third axis of rotation 12 substantially perpendicular to longitudinal axis 5.

Lamp 1 further comprises a control knob 13 configured to enable a user to move main actuator 7 in rotation and to block actuator 7 in at least one direction of rotation. Control knob 13 is both mounted free in rotation around longitudinal axis 5 to drive main actuator 7 in rotation and mounted free in translation along longitudinal axis 5 to block and release main actuator 7. Whatever the position of control knob 13, the latter remains fixedly secured to main actuator 7. Control knob 13 preferably has the shape of a hollow cylinder to form a cavity 14 for the movements of control knob 13 in rotation and in translation with respect to main actuator 7. Control knob 13 is mounted movable in translation along the axis of main actuator 7 between a driving position, illustrated in FIGS. 3*a*, 4*a* and 5*a*, in which control knob 13 drives main actuator 7 in rotation, and at least one blocking position, illustrated in FIGS. 3*b*, 4*b* and 5*b*, in which control knob 13 prevents rotation of main actuator 7 in at least one direction of rotation.

Figure 2:
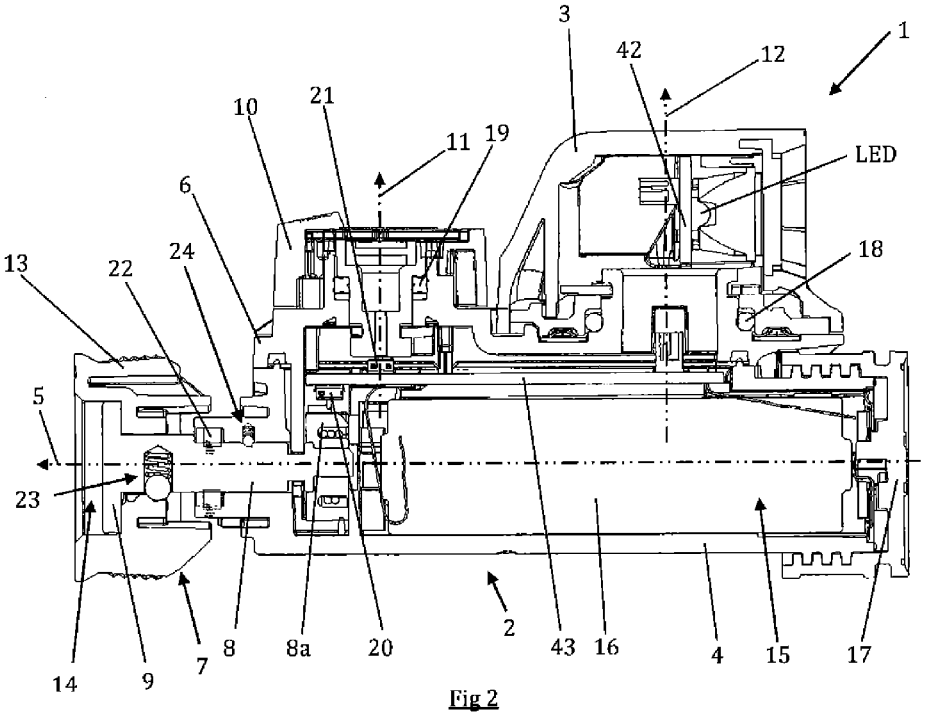
FIG. 2 schematically illustrates a cross-sectional view of FIG. 1.

A cross-sectional view of lamp 1 described in FIG. 1 has been represented in FIG. 2. Bottom part 4 of casing 2 comprises a housing 15 for a power supply source 16, such as a storage or disposable battery, to supply power to lighting module 3. Bottom part 4 comprises a sealing plug 17, at a second end opposite the first end, to close off housing 15. According to another embodiment, power supply source 16 can be located outside casing 2. Lamp 1 can comprise a first O-ring 18 situated around third axis of rotation 12, and a second O-ring 19 situated around second axis of rotation 11, in order to ensure the tightness between casing 2, lighting module 3 and additional actuator 10. Lighting module 3 further comprises an electric control circuit 42 of the lighting coupled to the LED. Casing 2 further comprises a main electric circuit 43 coupled to electric control circuit 42 and provided with at least a first switch 20 controlled by main actuator 7. Main electric circuit 43 preferably comprises a first pair of switches controlled by main actuator 7.

For example, when main actuator 7 rotates in one direction of rotation, it can command first switch 20 to extinguish the LED or LEDs of lamp 1, and when it rotates in the other direction of rotation, it can command the second switch to light the LED or LEDs, and also to vary the lighting intensity. As a variant, when it rotates in a first direction of rotation, main actuator 7 can command first switch 20 to reduce the lighting of the LED or LEDs or to extinguish the LED or LEDs of lamp 1, and when it rotates in a second direction of rotation, it can command the second switch to light the LED or LEDs or to increase the lighting intensity. Main electric circuit 43 can also further comprise another switch 21, or a second pair of switches, controlled by additional actuator 10.

According to a preferred embodiment, drive bar 8 is fitted through casing 2, with a part external to casing 2 and an internal part which extends inside casing 2. Lamp 1 further comprises an O-ring 22 situated around drive bar 8. At a second end opposite the end which is extended by head 9, the internal part of drive bar 8 comprises a cam 8 designed to be in contact with the switches of the first pair of main electric circuit 43. Cam 8*a* can comprise a protuberance and control of the switches is pulsed, or several protuberances and control of the switches is indexed according to the angular position of main actuator 7. When control of the switches of the first pair is pulsed, a spring can be provided situated between casing 2 and main actuator 7 to enable rotation of actuator 7 and to return the latter automatically to a rest position when actuator 7 is no longer solicited by the user. An additional spring situated between control knob 13 and casing 2 can also be provided to enable translation and rotation of control knob 13 when control knob 13 is in the drive position, and to return the latter to the blocking position when control knob 13 is no longer solicited by the user. Such an additional spring keeps control knob 13 by default in the blocking position.

According to another embodiment, drive bar 8 is only fitted outside casing 2. The controlled switches of the first pair each comprise a capacitive or inductive sensor, and main actuator 7 comprises a magnet which enables each switch to be opened or closed according to the angular position of main actuator 7. Lamp 1 advantageously comprises indexing means 23, 24 which will be described further on with reference to FIGS. 7*a* and 7*b*.

Figure 3A:
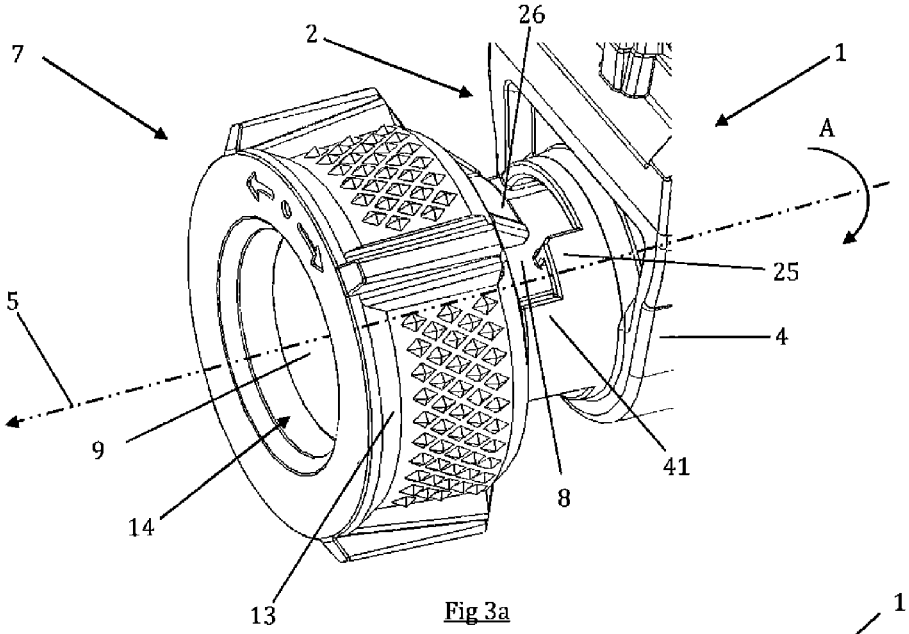
FIGS. 3*a* and 3*b* schematically illustrate a perspective view of another embodiment of the lamp according to the invention.
Figure 3B:
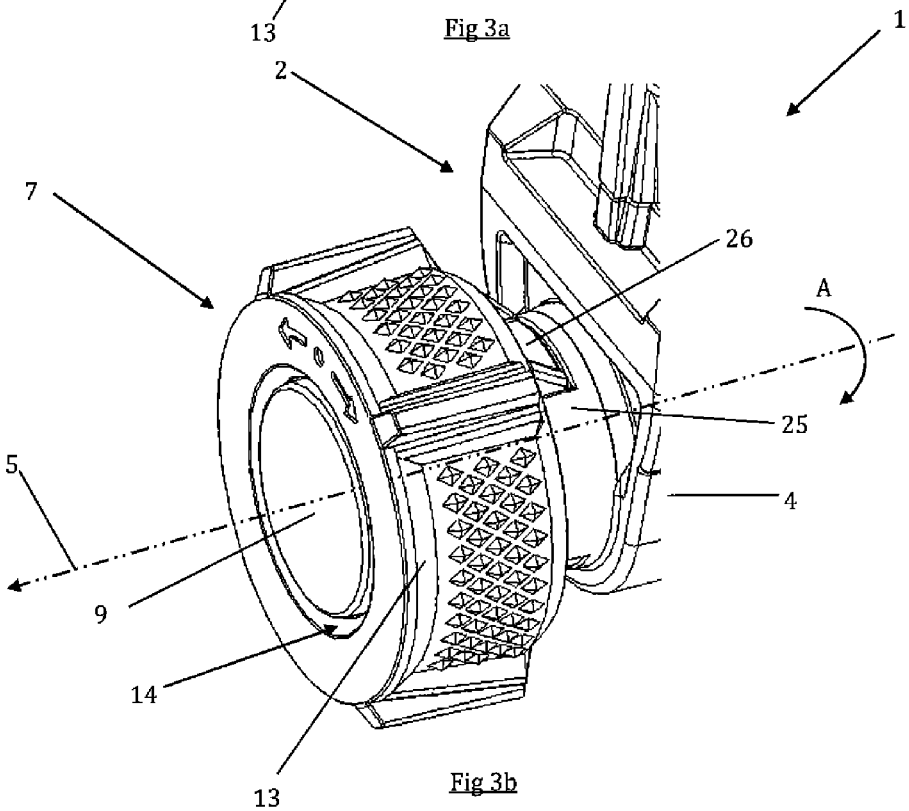

In FIGS. 3*a* and 3*b*, an embodiment of a portable electric lamp 1 has been represented comprising means for blocking main actuator 7 in one direction of rotation only. Bottom part 4 of casing 2 comprises a first stop 25 at the level of its first end, and control knob 13 comprises a pin 26 which operates in conjunction with first stop 25 to prevent main actuator 7 from rotating in a direction of rotation referenced A in FIGS. 3*a* and 3*b*. In FIG. 3*a*, control knob 13 is in the driving position in which it enables drive head 9 to be driven in both directions of rotation with respect to longitudinal axis 5. As a variant, bottom part 4 of casing 2 can comprise an additional stop 41 at the level of its first end, situated at a different level from that of first stop 25, which operates in conjunction with pin 26 so as to limit the travel of control knob 13 when knob 13 is in the driving position. At the end of travel of control knob 13, pin 26 is pressing against additional stop 41 and knob 13 prevents the user from increasing the rotation of actuator 7 in the direction of rotation referenced A. Additional stop 41 is particularly suitable when control of first switch 20 is pulsed. Thus, in the driving position, control knob 13 is free in rotation with a limited travel which is sufficient to control first switch 20. In FIG. 3*b*, control knob 13 is in the blocking position in which pin 26 is pressing against first stop 25 and control knob 13 prevents the user from moving actuator 7 in the direction of rotation referenced A. The user moves control knob 13 in translation along drive bar 8 to make control knob 13 move from the driving position to the blocking position, and vice-versa.

Figure 4A:
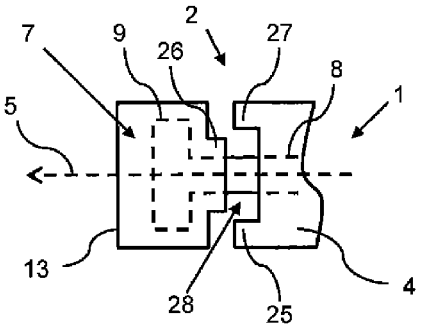
FIGS. 4*a*, 4*b* and 5*a*, 5*b* schematically illustrate other embodiments of the lamp according to the invention.
Figure 4B:
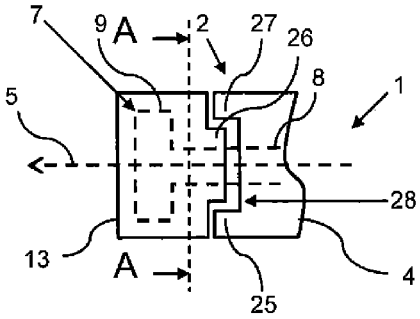

In FIGS. 4*a* and 4*b*, a schematic view of another embodiment of lamp 1 has been represented. In this other embodiment, casing 2 comprises two stops 25, 27 situated at the level of the first end of bottom part 4 and forming an insert 28 for pin 26. FIG. 4*a* illustrates control knob 13 in the driving position, and FIG. 4*b* illustrates control knob 13 in the blocking position. In the blocking position, pin 26 is housed in insert 28 and the two stops 25, 27 prevent any rotation of control knob 13. Control knob 13 thus prevents actuator 7 from rotating in both directions of rotation, and actuator 7 is in a locked position in which it is immobilised.

Figure 5A:
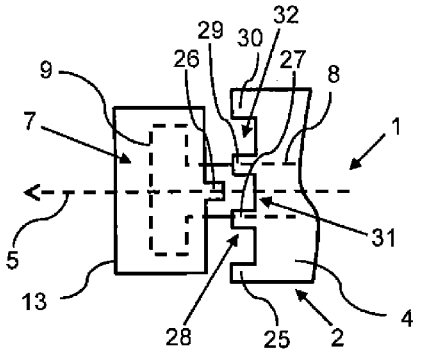
Figure 5B:
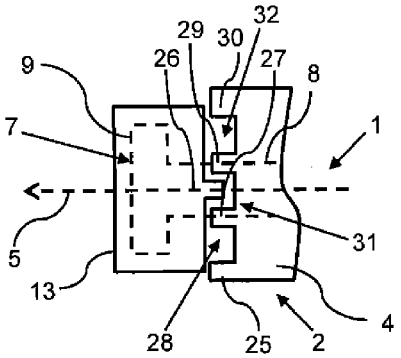

In FIGS. 5*a* and 5*b*, a schematic view of another embodiment of lamp 1 has been represented. In this other embodiment, casing 2 comprises several stops 25, 27 and 29, 30. Stops 25, 27 and 29, 30 are arranged in such a way as to form several inserts 28, 31, 32 for pin 26. In particular, each pair of stops forms an insert for pin 26. Control knob 13 can thus take several blocking positions where pin 26 is housed in an insert between two stops, in each blocking position. FIG. 5*a* illustrates control knob 13 in the driving position, and FIG. 5*b* illustrates control knob 13 in a blocking position where pin 26 is housed in insert 31 between stops 27, 29. In the blocking position, control knob 13 prevents actuator 7 from rotating in both directions of rotation.

Figure 6A:
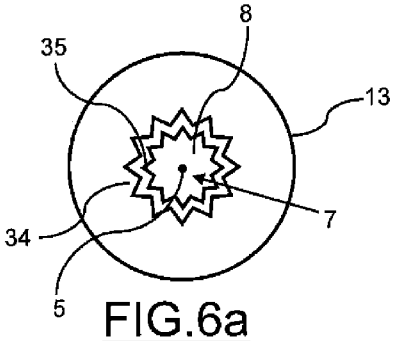
FIGS. 6*a* and 6*b* schematically illustrate cross-sectional views along the line A-A of FIG. 4*b*.
Figure 6B:
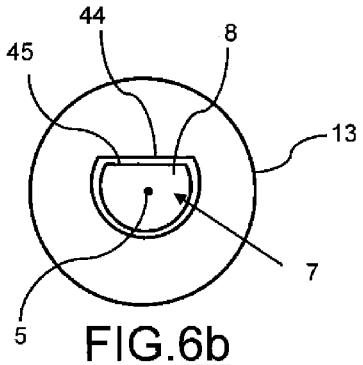

In FIGS. 6*a* and 6*b*, two schematic cross-sectional views have been respectively represented along line A-A of FIG. 4*b*. According to an embodiment illustrated in FIG. 6*a*, control knob 13 comprises at least one tenon 34 designed to slide in at least one serration 35 provided on drive bar 8. Tenon 34 collaborates with serration 35 to enable the user to move drive bar 8 in rotation. Tenon 34 can further slide in serration 35 when the user translates control knob 13 between the driving position and the blocking position. According to another embodiment illustrated in FIG. 6*b*, control knob 13 comprises a flat surface 44 and drive bar 8 also comprises a flat surface 45 located facing that of control knob 13 so as to enable translation of knob 13 along drive bar 8 and to enable knob 13 to drive bar 8 in rotation. In both the embodiments, head 9 of drive bar 8 forms a stop to prevent control knob 13 from being separated from lamp 1.

Figure 7A:
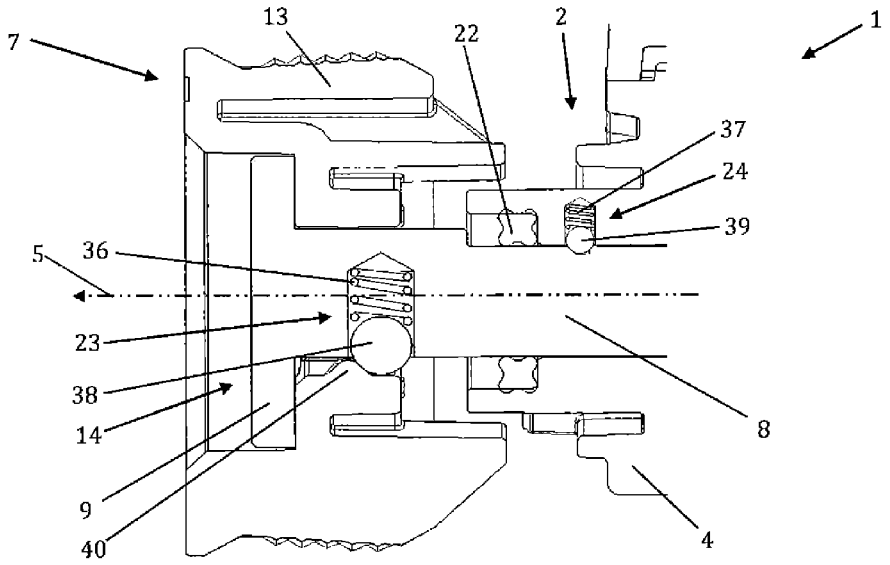
FIGS. 7*a* and 7*b* schematically illustrate embodiments of the indexing means of the lamp according to the invention.
Figure 7B:
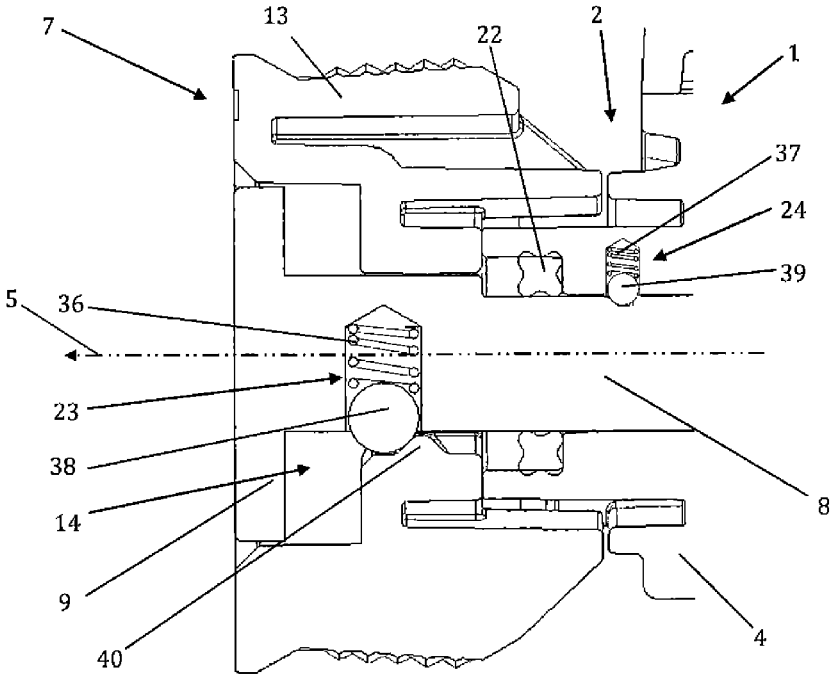

In FIGS. 7*a* and 7*b*, cross-sectional views of lamp 1 described in FIG. 1 have been represented illustrating embodiments of the means for indexing in translation 23 and of the means for indexing in rotation 24. Each of the indexing means 23, 24 comprise a spring 36, 37 and a ball 38, 39 fitted on one end of the associated spring 36, 37.

The means for indexing in translation 23 enable control knob 13 to be held in the driving position or in the blocking position. The means for indexing in translation 23 comprise a housing formed in drive bar 8 to accommodate spring 36 and associated ball 38 so that ball 38 is kept pressing against control knob 13 by the associated spring 36. Furthermore, ball 38 can move perpendicularly to axis of rotation 5 of main actuator 7, compressing the associated spring 36, when control knob 13 is translated by the user from the driving position to the blocking position, and vice-versa. Control knob 13 further comprises an internal pin 40 formed on the internal part of control knob 13 and salient in cavity 14. Internal pin 40 collaborates with ball 38 so as to keep control knob 13 in a stable translation position. In FIG. 7*a*, internal pin 40 is in front of ball 38 and control knob 13 is in the driving position. In FIG. 7*b*, internal pin 40 is behind ball 38 and control knob 13 is in the blocking position. Control knob 13 moves from one translation position to the other when the user moves control knob 13 in translation along longitudinal axis 5 and internal pin 40 repels ball 38 which compresses the associated spring 36. Compression of spring 36 results in a resistance force tending to prevent involuntary translation of control knob 13.

The means for indexing in rotation 24 enable main actuator 7 to be secured in a determined angular position. It is particularly suitable when control of first switch 20 is indexed according to the angular position of actuator 7. The means for indexing in rotation 24 comprise a housing formed in bottom part 4 of casing 2 to accommodate spring 37 and associated ball 39, so that ball 39 is kept pressing against drive bar 8 by associated spring 37. Furthermore, ball 39 can move perpendicularly to axis of rotation 5 of main actuator 7, compressing the associated spring 37, when actuator 7 is moved angularly by the user. Drive bar 8 comprises several pins, not represented in the figure for simplification purposes, formed around bar 8. The pins cooperate with ball 39 so as to keep actuator 7 in a stable rotation position.

A portable electric lamp is thus provided having a simple and efficient blocking system of a rotary actuator. Advantageously, the lamp provided is particularly compact and tightly sealed as the actuator does not translate inside the casing of the lamp. The lamp can provide several very different types of lighting, in particular of different colours and various lighting intensities, while at the same time enabling the actuator to be blocked in position either to keep the selected lighting or to keep the lamp extinguished.

The invention claimed is:

1. A portable electric lamp with a compact casing housing a lighting module and an electric circuit coupled to the lighting module and provided with a controlled switch, the portable electric lamp comprising:

an actuator rotating around an axis of rotation to control the switch, the actuator being mounted fixed in translation in the direction of said axis of rotation; and a control knob rotating around the axis of rotation of the actuator, the control knob further being mounted movable in translation along the axis of rotation of the actuator between a driving position in which the control knob drives the actuator in rotation and at least one blocking position in which the control knob prevents rotation of the actuator in at least one direction of rotation.

2. The portable electric lamp according to claim 1, wherein the control knob comprises a pin, and the casing comprises at least one stop to block the pin in at least one direction of rotation of the actuator when the control knob is in said blocking position.

3. The portable electric lamp according to claim 2, wherein the casing comprises at least two stops arranged around an insert shaped such as to receive the pin, when the control knob is in said blocking position, so as to prevent rotation of the actuator in both directions of rotation.

4. The portable electric lamp according to claim 1, comprising means for indexing in translation to keep the control knob in a determined translation position.

5. The portable electric lamp according to claim 1, wherein the actuator comprises a drive bar fitted through the casing and provided with a cam designed to control the switch.

6. The portable electric lamp according to claim 1, wherein the switch comprises an inductive or capacitive sensor and the actuator comprises a magnet designed to control the switch.

7. The portable electric lamp according to claim 1, comprising at least one spring fitted between the casing and the actuator to enable rotation of the actuator and to return the latter to a rest position.

8. The portable electric lamp according to claim 1, comprising at least one spring fitted between the control knob and the casing to enable translation and rotation of the control knob and to return the latter from the driving position to said blocking position.

9. The portable electric lamp according to claim 1, comprising means for indexing in rotation to keep the actuator in a determined angular position.

10. The portable electric lamp according to claim 9, wherein the casing comprises several stops and several inserts, each insert being located between two stops and being shaped so as to receive the pin, when the control knob is in said blocking position so as to prevent rotation of the actuator in both directions of rotation.

* * * * *